US005971128A

United States Patent [19]

Billington et al.

[11] Patent Number: 5,971,128

[45] Date of Patent: Oct. 26, 1999

[54] APPARATUS FOR VALIDATING ITEMS OF VALUE, AND METHOD OF CALIBRATING SUCH APPARATUS

[75] Inventors: Gregory John Billington, Reading; Paul Franklin Steel, Wokingham, both of United Kingdom

[73] Assignee: Mars, Incorporated, McLean, Va.

[21] Appl. No.: 08/793,762

[22] PCT Filed: Aug. 9, 1995

[86] PCT No.: PCT/GB95/02125

§ 371 Date: Mar. 5, 1997

§ 102(e) Date: Mar. 5, 1997

[87] PCT Pub. No.: WO96/07992

PCT Pub. Date: Mar. 14, 1996

[30] Foreign Application Priority Data

Sep. 9, 1994 [GB] United Kingdom ..... 9418185

[51] Int. Cl.[6] ..... G07D 5/08

[52] U.S. Cl. ..... 194/317

[58] Field of Search ..... 194/206, 207, 194/317, 318, 319

[56] References Cited

U.S. PATENT DOCUMENTS

| | | | |
|---|---|---|---|
| 4,451,929 | 5/1984 | Yoshida . | |
| 4,538,719 | 9/1985 | Gray et al. | 194/317 |
| 4,572,349 | 2/1986 | Furuya et al. | 194/318 |
| 4,951,799 | 8/1990 | Kai | 194/317 |
| 5,052,043 | 9/1991 | Gaborski . | |
| 5,067,604 | 11/1991 | Metcalf | 194/317 X |
| 5,167,313 | 12/1992 | Dobbins et al. | 194/317 |

FOREIGN PATENT DOCUMENTS

| | | |
|---|---|---|
| 0 101 276 | 2/1984 | European Pat. Off. . |
| 0 227 453 | 7/1987 | European Pat. Off. . |
| 0 394 067 | 10/1990 | European Pat. Off. . |

*Primary Examiner*—F. J. Bartuska
*Attorney, Agent, or Firm*—Fish & Richardson P.C.

[57] ABSTRACT

A coin or banknote validator is calibrated to accept items of value by taking successive measurements of items and using them to update acceptability data which defines at least one acceptability criterion for testing. Each measurement is first checked against a suitability criterion, and is only used for updating the acceptability data if the suitability criterion is met. In this way, the acceptability data can be derived without storing all the individual measurements, while still rejecting those measurements which are statistically unsound. The suitability criteria is such that if a measurement differs from the current acceptability data by more than a predetermined amount, the criterion is not met. To avoid problems resulting from the first measurement being unsound, this first measurement is discarded if it does not lie within a predetermined range of the second measurement.

12 Claims, 4 Drawing Sheets

APPARATUS FOR VALIDATING ITEMS OF VALUE, AND METHOD OF CALIBRATING SUCH APPARATUS

BACKGROUND OF THE INVENTION

This invention relates to apparatus for validatina items of value, and to methods of calibrating such apparatus. The invention will be described in the context of coin validators, but is also applicable to banknote validators and validators for other items of value.

It is well known to take measurements of coins and apply acceptabilty tests to determine whether the coin is valid and the denomination of the coin. The acceptability tests are normally based on stored acceptability data. One common technique (see, e.g. GB-A-1 452 740) involves storing "windows", i.e. upper and lower limits for each test. If each of the measurements of a coin falls within a respective set of upper and lower limits, then the coin is deemed to be acceotable. The acceptability data could instead represent a predetermined value such as a median, the measurements then being tested to determine whether they lie within predetermined ranges of that value. Alternatively, the acceptance data could be used to modify each measurement and the test would then involve comparing the modified result with a fixed value or window. Alternatively, the acceptance data could be a look-up table which is addressed by the measurements, and the output of which indicates whether the measurements are suitable for a particular denomination (see, e.g. EP-A-0 480 736, and US-A-4 951 799). Instead of having separate acceptance criteria for each test, the measurements may be conbined and the result compared with stored acceptance data (cf. GB-A-2 238 152 and GB-A-2 254 949). Alternatively, some of these techniques could be combined, e.g. by using the acceptability data as coefficients (derived, e. g. using a neural network technique) for combining the measurements, and possibly for performing a test on the result. A still further possibility would be for the acceptability data to be used to define the conditions under which a test is performed (e.g. as in US-A-4 625 852).

It is known to use statistical techniques for deriving the data, e.g. by feeding many items into the validator and deriving the data from the test measurements in a calibration operation. It is also known for the validator to have an automatic recalibration function, sometimes known as "self-tuning", whereby the acceptance data is regularly updated on the basis of measurements performed during testing (see for example EP-A-0 155 126, GB-A-2 059 129, and US-A-4 951 799).

Normally, the acceptance data produced by the calibration operation is characteristic of the specific type of item to be validated. However, it is alternatively possible for the data to be independent of the properties of the item itself, and instead to be characteristic of just the validation apparatus (e.g. to represent how much the apparatus deviates in its measurements from a standard) so that this data in combination with further data representing the standard properties of an item are sufficient for validation.

It is sometimes desirable to calibrate or recalibrate an existing validator in the field (c.f. GB-A-2 199 978). For example, if the validator is arranged to validate a certain range of denominations, it may be desired to add a different denomination to that range, or to substitute one of those denominations for a different one. However, it is desirable to avoid the need to perform a very large number of tests during the calibration step if the apparatus is in the field, and also if the calibration is carried out using the internal control system of the validator or possibly using a hand-held terminal connected to the validator, there is a limit to the amount of available memory capacity, which inhibits the use of normal statistical techniques. The results therefore may be statistically unreliable.

EP-A-0 227 453 describes a coin validation apparatus which can be put into a "training" mode, in which a coin is inserted into the testing apparatus four times in succession, in order to develop acceptance criteria for validating further coins of the same type. Four sets of measurements are made to ensure that the results are representative of the particular coin type. The sets of measurements must match closely, in order for the operation to be completed. This prevents possible errors due to an incorrect coin being inserted. If four consecutive close matches are not found, then the entire operation must be repeated. Once there are four consecutive close matches, the measurements are then averaged, and the results define acceptance criteria used in the test mode of the apparatus. The use of only four measurements means that the resulting acceptance criteria may not be statistically very accurate. The disclosed technique requires the storage of all the measurements for all four coins, and therefore increasing the number of required tests during the calibration mode will substantially increase the memory requirements.

SUMMARY OF THE INVENTION

Aspects of the present invention are set out in the accompany claims.

Arrangements according to the invention could employ any of the techniques mentioned above, and the above-identified patent specifications are incorporated herein by reference.

In accordance with the method of the invention, successive measurements are used for successively updating the acceptability data. Thus, it is not essential that these measurements thereafter be retained, so that the memory requirement can be reduced. Even though not all the measurements are retained, it is still possible to apply suitability criteria to each of the measurements to determine whether it is suitable for use in updating the acceptability data. Thus, for example, if a measurement differs from the current acceptability data by more than a predetermined amount, it is deemed anomalous and not used for updating the acceptability data. This is particularly useful in the context of coin validators, and especially those in which the coin is allowed to pass through the validator under the force of gravity (rather than being transported on a conveyor) In these circumstances, a coin may follow a different path from the intended one, thus giving rise to the anomalous measurement. However, anomalies are also possible in other circumstances, such as in banknote validation wherein the banknote may be aligned in a slightly incorrect manner as it passes through the validator, or is dirty or damaged.

A problem may arise if the first of the tested items produces measurements which are statistically unsound. If these are used to derive acceptability data, then subsequent (non-anomalous) measurements may incorrectly be treated an anomalous because of the disparity with the first measurement. To deal with this, in a preferred embodiment of the invention, the first measurement is discarded if it does not lie within a predetermined range of the second measurement. If the first measurement is discarded, then the second measurement is thereafter treated as though it were the first. Accordingly, the acceptability data only starts being updated when there are two successive measurements lying within a predetermined range.

Preferably, means are provided for preventing the acceptability data from being used in subsequent testing operations if an inadequate number of measurements have passed the suitability criterion and/or if an excessive number of measurements have failed the suitability criterion.

BRIEF DESCRIPTION OF THE DRAWINGS

An arrangement embodying the invention will now be described by way of example with reference to the accompanying drawings, in which.

DESCRIPTION OF THE PREFERRED EMBODIMENTS

Figure 1:
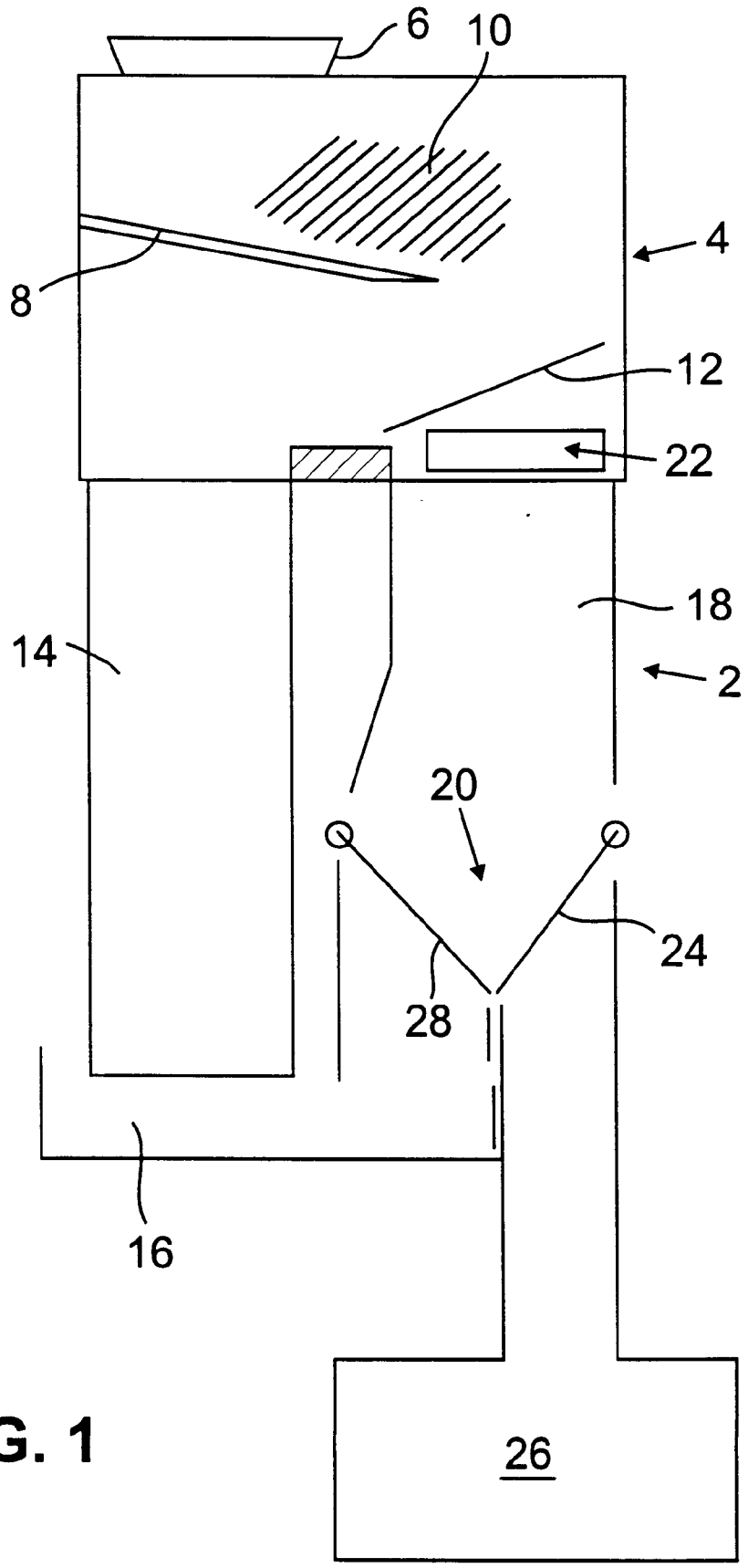
FIG. 1 is a schematic view of a coin mechanism including a coin validator in accordance with the invention.

Referring to FIG. 1, a coin mechanism 2 has a validator 4 which comprises a hopper 6 into which coins can be inserted. The coins fall on to a ramp 8 and then roll under gravity down the ramp past a testing region indicated by the shaded section 10. The coins then fall towards an accept gate shown schematically at 12. If the coins have been tested and found not to be genuine, the coins are diverted by the accept gate 12 into a reject path 14, which delivers the coins to a refund tray 16.

If the coins are acceptable, a solenoid is energised to cause the accept gate 12 to shift into a position in which it opens an accept path 18 leading to an escrow bucket 20. Coins entering the accept path 18 move past a sensing arrangement shown generally at 22. After the sensing arrangement 22 has detected that a coin has moved past, it triggers the accumulation of credit, thus permitting a user to operate a machine (not shown) in which the validator is housed. After the machine has provided goods or a service to the value of the accumulated credit, an escrow accept gate 24 is opened to allow a coin or coins held thereby to fall into a cash box 26. Before provision of the goods or services, the user can alternatively press an escrow return button (not shown) to cause an escrow return gate 28 to open and so allow coins in the escrow bucket 20 to travel to the refund tray 16.

Arrangements generally of this type are well known, although the physical structure of such arrangements varies substantially.

Figure 2:
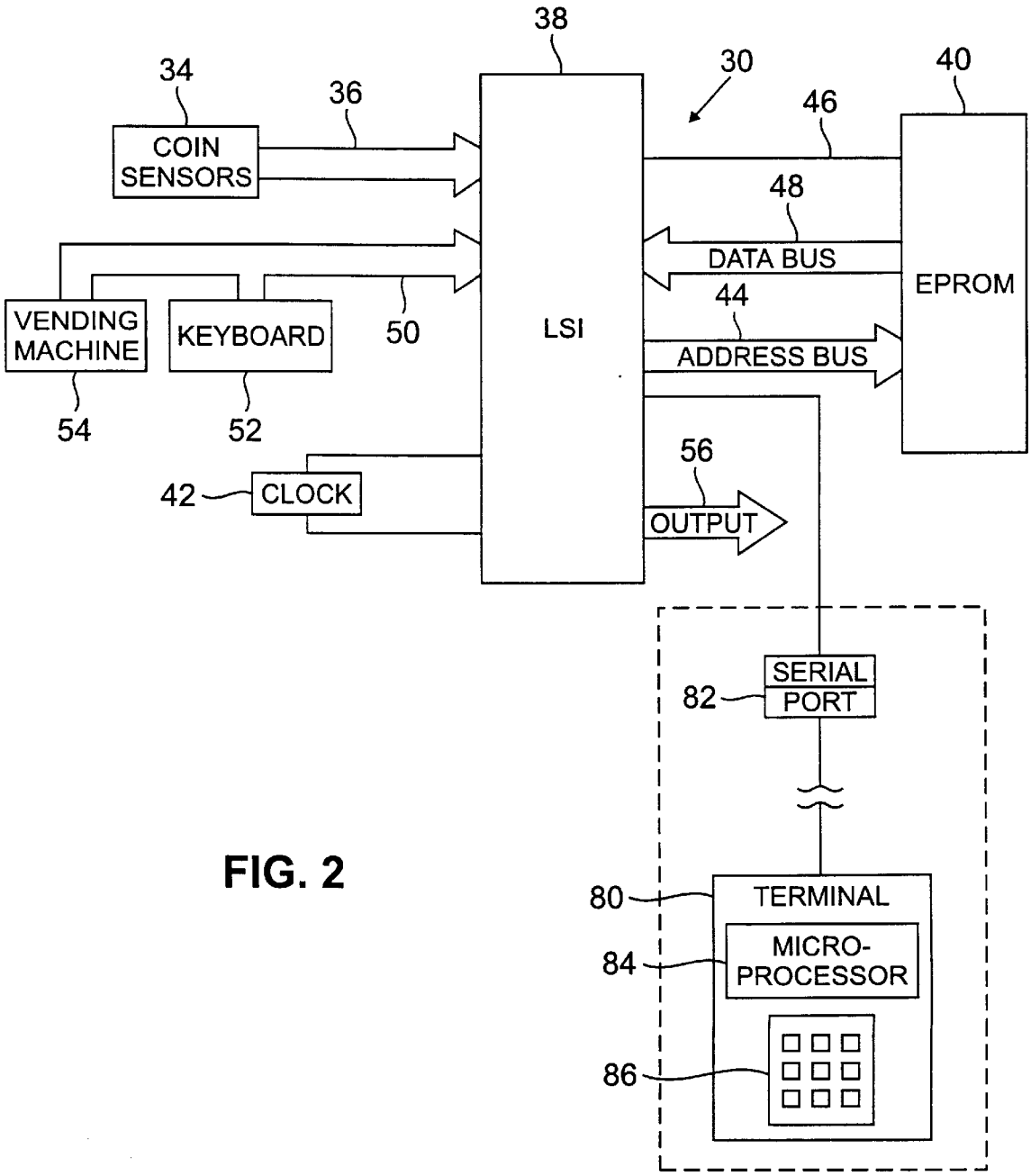
FIG. 2 is a schematic block diagram of the circuitry of the validator.

The circuitry 30 of the coin testing apparatus shown schematically in FIG. 2 includes a set of coin sensors indicated at 34 forming the testing section 10. Each of these sensors is operable to measure a different property of a coin inserted in the apparatus, in a manner which is in itself well known. Each sensor provides a signal indicating the measured value of the respective parameter on one of a set of output lines indicated at 36.

An LSI 38 receives these signals. The LSI 38 contains a read-only memory storing an operating program which controls the way in which the apparatus operates. Instead of an LSI, a standard microprocessor may be used. The LSI is operable to compare each measured value received on a respective one of the input lines 36 with values (constituting acceptance data) stored n predetermined locations in an EPROM 40. The EPROM 40 could be any other type of memory circuit with alterable contents, and could be formed of a single or several integrated circuits, or may be combined with the LSI 36 (or microprocessor) into a single integrated circuit.

The LSI 38, which operates in response to timing signals produced by a clock 42, is operable to address the EPROM 40 by supplying address signals on an address bus 44. The LSI also provides a "EPROM-enable" signal on line 46 to enable the EPROM. In response to the addressing operation, a value is delivered from the EPROM 40 to the LSI 38 via a data bus 48.

The LSI 38 also has input lines 50 for receiving signals from a keyboard 52 housed in the host vending machine and accessible only to an operator who has a key to unlock the machine, and for receiving signals from other parts of the vending machine indicated generally at 54. Instead of a keyboard, simple switches (e.g. Dual-In-Line switches) could be used. Alternatively, the LSI could be controlled by signals received from other equipment to which the validator is connected.

By way of example, one embodiment of the invention may comprise three sensors, for respectively measuring the conductivity, thickness and diameter of inserted coins. On insertion of a coin, the measurements produced by the three sensors 34 are compared by the LSI 38 with selected values stored in the EPROM 40. If the measured thickness value lies within a predetermined range of the stored thickness value for a particular coin, then the thickness test for that coin has been passed. Similarly, the validator checks whether the diameter measurement and the conductivity measurement are within predetermined ranges of stored values.

If and only if all the measured values fall within the three stored ranges for a particular coin denomination which the apparatus is designed to accept, the LSI 38 produces an ACCEPT signal on one of a group of output lines 56, and a further signal on another of the output lines 56 to indicate the denomination of the coin being tested. The accept gate 12 adopts one of two different states depending upon whether the ACCEPT signal is generated, so that all tested coins deemed genuine are directed along the accept path 18 and all other tested items along the reject path 14.

Figure 3:
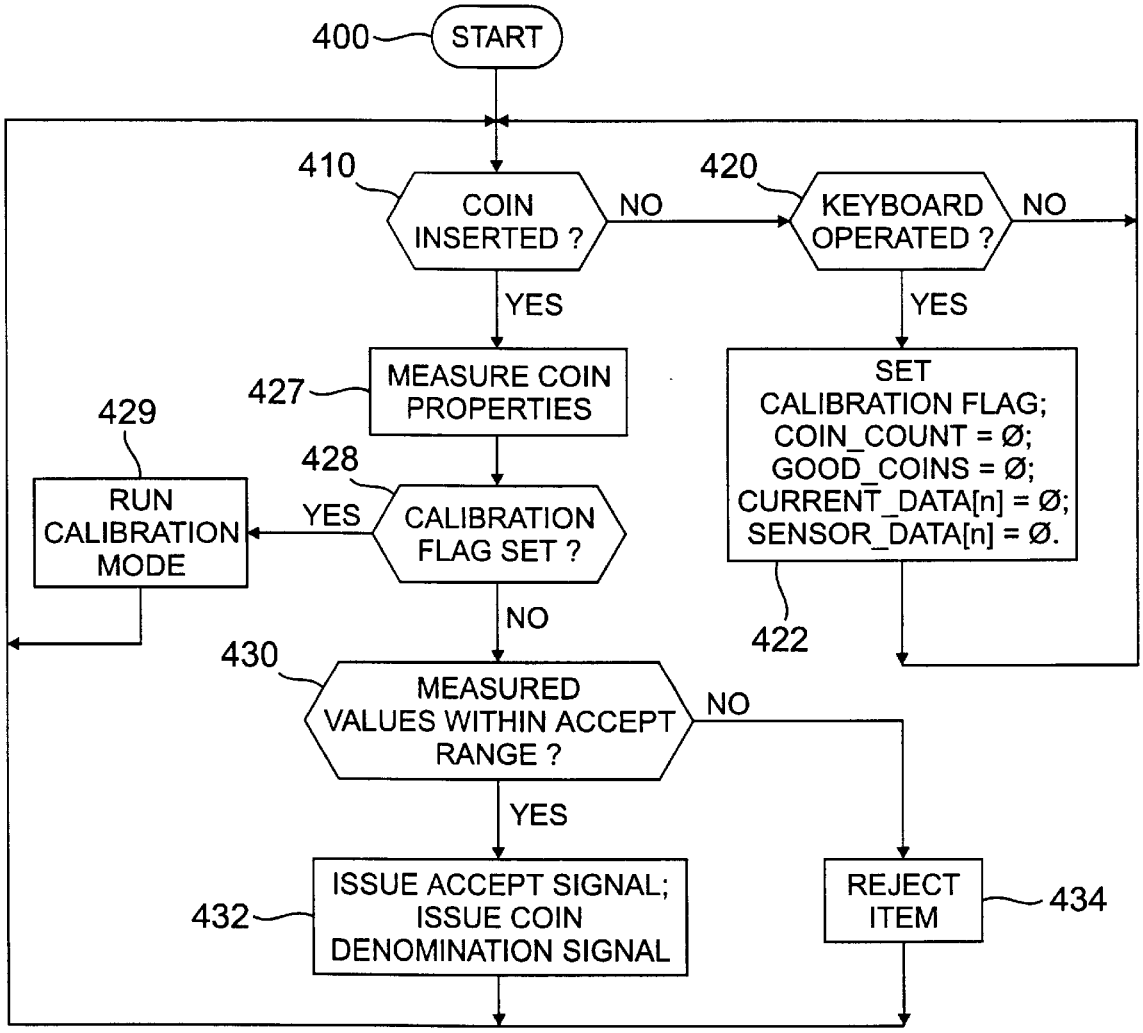
FIG. 3 is a flowchart illustrating the operation of the validator.

FIG. 3 shows an example of how the validator may be arranged to operate, the figure relating only to those Darts of the operation which are relevant to the present invention. The operation starts at step 400, and then following an initialization operation proceeds to step 410 where the validator checks to determine whether a coin has been inserted. If no, the program poroceeds to step 420 to determine whether the keyboard 52 has been operated in such a manner as to instruct the machine to enter a calibration mode. For example, the machine may check to determine whether the operator has pressed a specific key or key sequence associated with this mode. If so, the proagram proceeds to step 422 to set a CALIBRATION flag indicating that the calibration mode has been entered. Various variables are also initialised, as described below. In any event, the program, loops back to step 410, so that the validator again checks to determine whether a coin has been inserted.

Figure 4:
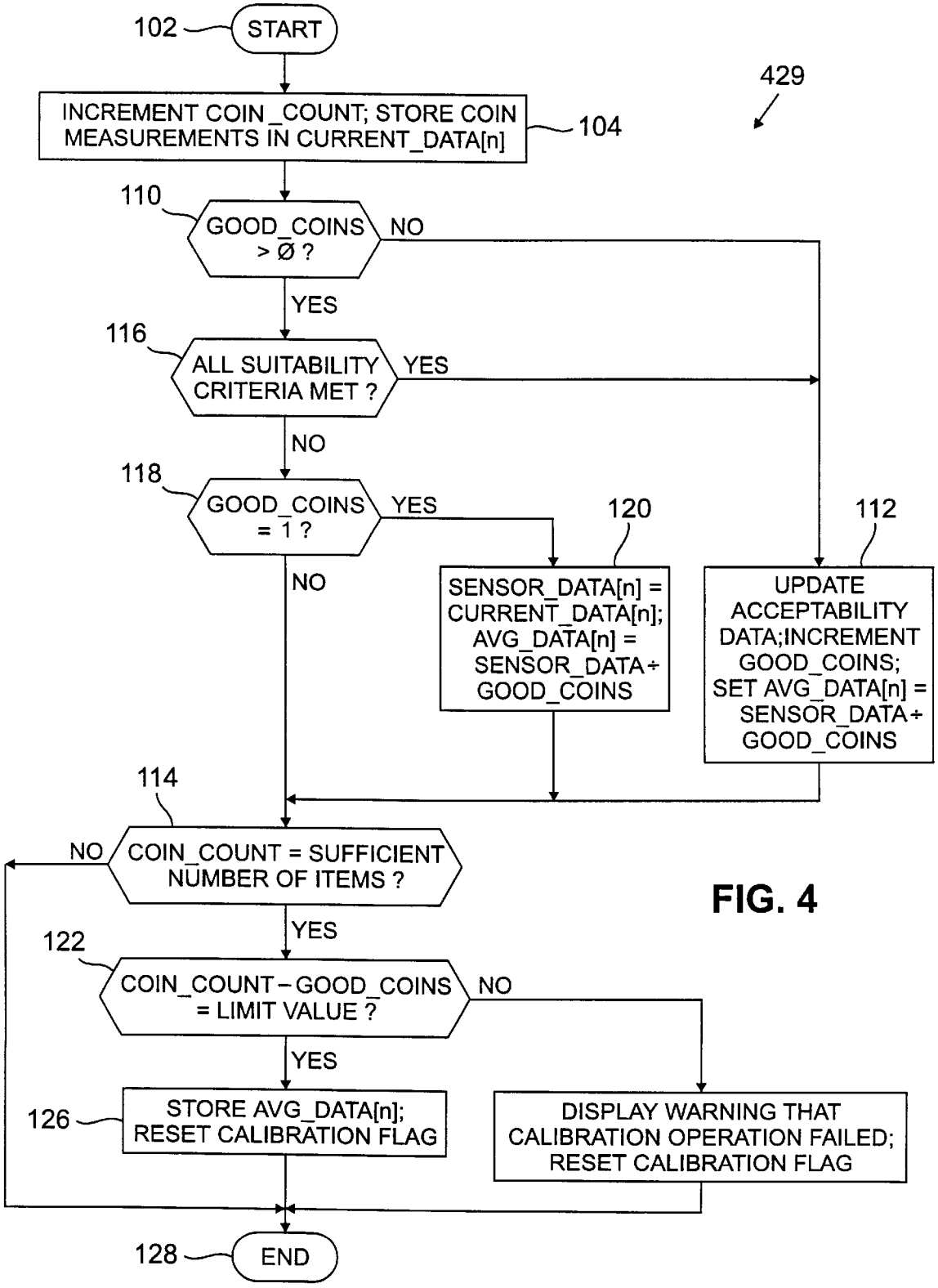
FIG. 4 is a flowchart illustrating the calibration part of the operation.

The program proceeds in this fashion until a coin is inserted, and then proceeds to step 427. At this step the coin properties are measured.

subsequently, at step 428, the program checks whether the CALIBRATION flag is set. If so, the calibration routine 429 (described in more detail in connection with FIG. 4) is performed. Otherwise the program proceeds to step 430.

At step 430, the program checks whether the measured values fall within the ranges for an acceptable coin, as described above. If so, the program proceeds to step 432, whereupon the ACCEPT signal and the signal indicating the denomination of the inserted coin are issued. If the measured properties did not fall within any of the stored sets of ranges, the program proceeds to step 434, where the inserted item is rejected, and then loops back to step 410.

Assuming that the calibration routine is to be entered, then the step 422 initialises the following variables:

COIN_COUNT: the number of coins measured during the calibration operation;

GOOD_COINS: the number of coins whose measurements have passed the suitability criteria;

CURRENT_DATA[n]: an n-dimensional array representing the n measurements of an item currently being measured;

SENSOR_DATA[n]: an n-dimensional array, each element of the array representing the accumulated total of the measurement results (for a particular type of measurement) for all items whose measurements have passed the suitability criteria.

All these variables are set to zero at step 422.

Subsequently, the calibration routine 429 (see FIG. 4) is executed. This starts at step 102. At step 104, COIN_COUNT is incremented and the coin measurements are stored in CURRENT_DATA[n]. At step 110, the program checks to determine whether GOOD_COINS is greater than zero. Assuming that it is not, i.e. that no coins have yet had their measurements pass the suitability criteria, then the program proceeds to step 112, whereupon the current readings are used to update the acceptability data. Thus, the current values of the elements of SENSOR_DATA[n] (which will initially be zero) are increased by the values of CURRENT_DATA[n]. Also at step 112, the value of GOOD_COIN is incremented.

The step 112 then involves the setting of the elements of another variable array, AVERAGE_DATA[n], equal to the corresponding element of SENSOR_DATA[n] divided by the value of GOOD_COINS. AVERAGE_DATA[n] therefore represents the average of the measurements which have passed the suitability criteria.

Thereafter, at step 114, the program determines whether a sufficient number (for example 20) of items have been tested, i.e. COIN_COUNT=20?, and if not, the routine ends at step 128, so the program loops back to step 410 (FIG. 3). After the next coin has been tested, step 110 determines that GOOD_COINS is greater than zero, and therefore proceeds to step 116. At this step, a suitability criterion is applied to each of the coin's measurements. If all the suitability criteria are met, the program proceeds to step 112, whereupon GOOD_COINS is incremented, and the elements of CURRENT_DATA[n] are added to SENSOR_DATA[n]. Otherwise, the program proceeds to a "reject readings" step 118.

The suitability test at step 116 is failed if, for any one of the n measurements:

ABS(CURRENT_DATA[n]−AVERAGE_DATA[n]) >window[n], where window[n] is an array containing predetermined values for each measurement. Each value represents a range within which successive measurements must fall for the measurements to be deemed suitable. If the normal testing operation of the validator involves comparing the measurement of an item with upper and lower limits, then window[n] may represent the difference between these limits.

At step 118, which is reached if at least one of the suitability criteria is failed, the program tests to determine whether the value of GOOD_COINS is equal to one. If it is not equal to one, the program proceeds to step 114, i.e. the CURRENT_DATA[n] readings are simply ignored, and the value of GOOD_COINS is not incremented. However, if GOOD_COINS equals one, i.e. only one set of measurements has been used to contribute towards the current values of SENSOR_DATA[n] and AVERAGE_DATA[n], there is a possibility that these existing measurements are anomalous. Accordingly, the program proceeds to step 120, where the values of SENSOR_DATA[n] are set equal to CURRENT_DATA[n] (so that the CURRENT_DATA[n] for the previous item is discarded) and the values of AVERAGE_DATA[n] are re-calculated to be SENSOR_DATA[n] divided by GOOD_COINS.

This operation continues until, at step 114, it is detected that 20 items have been tested.

The program then proceeds to step 122. Here, the program determines whether the difference between COIN_COUNT and GOOD_COINS is less than a predetermined limit value. This difference represents the number of items rejected because the suitability criteria were not met. If this number is large, i.e. if the test at step 122 is failed, then the program proceeds to step 124, whereupon a warning displace is provided to indicate that the re-calibration operation has failed. Otherwise, the program proceeds from step 122 to step 126. At this point, the value of AVERAGE_DATA[n] is stored in the appropriate place in the memory (EPROM 40) for use in subsequent testing operations. As indicated above, these testing operations involve taking measurements corresponding to those made in the calibration operation, and then determining whether or not these lie within a predetermined window width (possibly window[n] mentioned above) of the stored mean (i.e. AVERAGE_DATA [n]).

At either step 126 or step 124, the CALIBRATION flag is reset, so that the calibration routine ends and the apparatus returns to the normal test mode.

If a "self-tuning" facility is provided then the variables used by this facility may also be initialised at step 126.

Instead of using the internal program of the validator, in an alternative embodiment the calibration routine is stored in a separate hand-held terminal 80 (FIG. 2) which can be connected to a serial port 82 of the validator and which includes a microprocessor 84 and a keyboard 86. In this case the validator routine of FIG. 3 is responsive at step 420 to instructions from the terminal 80 and passes the coin measurements to the terminal when control is passed to the terminal's processor 84 at step 429.

The invention has been described in the context of coin validators, but it is to be noted that the term "coin" is employed to mean any coin (whether valid or counterfeit), token, slug, washer, or other metallic object or item, and especially any metallic object or item which could be utilised by an individual in an attempt to operate a coin-operated device or system. A "valid coin" is considered to be an authentic coin, token, or the like, and especially an authentic coin of a monetary system or systems in which or with which a coin-operated device or system is intended to operate and of a denomination which such coin-operated device or system is intended selectively to receive and to treat as an item of value.

Indeed the invention is considered to be particularly applicable to the validators which can handle (possibly in addition to ordinary coins) tokens which may be specially manufactured for particular establishments, and may bear a general resemblance to coins in that they are metallic and generally disc-shaped and of a similar size, although would normally be distinguishable from genuine coins by a coin validator. Recalibration of such validators to make them suitable for particular establishments is frequently desired.

In the above description, it is assumed that the calibration is carried out by measuring items which correspond to the type of items which are validated in normal use. It would also be possible for at least part of the calibration to involve the measuring of items which the apparatus is intended to reject, i.e. "slugs". In this case, the acceptance data generated by the calibration operation would be used in such a way that tested items which produce measurements similar to those used to derive the acceptance data would be rejected.

Although the above description relates to an arrangement in which the acceptability data contains only averages of measurements which are used as the median of acceptance ranges, it is possible additionally or alternatively to derive other data, such as standard deviations used to determine the widths of the acceptance ranges.

We claim:

1. A method of calibrating apparatus for validating items of value, the apparatus having a calibration mode for setting up acceptance criteria used in the testing of items of value and a test mode for testing such items, and wherein the apparatus is switchable between the calibration mode and the test mode, the method comprising:

causing the apparatus to take a plurality of genuine item measurements while the apparatus is in the calibration mode, applying suitability criteria to the measurements, and deriving at least one acceptance criterion from measurements which meet the suitability criteria, so that the acceptance criterion can be used in the test mode of the apparatus for testing items;

wherein the suitability criteria are applied to the measurements in succession and acceptability data used to define the acceptance criterion is successively updated in accordance with successive measurements determined to be suitable.

2. A method as claimed in claim 1, wherein a measurement meets a suitability criterion if it is within a predetermined range of current acceptability data.

3. A method as claimed in claim 1, including the step of taking a first measurement before said plurality of measurements, but preventing said first measurement from being used to produce the acceptability data if it does not lie within a predetermined range of the next measurement, in which case the next measurement is treated as the first measurement for use in producing the acceptability data.

4. A method as claimed in claim 1, including the step of causing the apparatus to measure a plurality of different items of the same type in order to derive said plurality of item measurements.

5. A method as claimed in claim 1, in which each item measurement is discarded after it is used to update the acceptability data.

6. A method as claimed in claim 1, wherein the acceptability data represents the average of measurements which have met the suitability criterion.

7. A method as claimed in claim 1, when the apparatus is operable to perform a plurality of measurements on each item, and to use the plurality of measurements for updating the acceptability data, which is thereafter usable by the apparatus in defining a plurality of acceptance criteria for testing items, and wherein a respective suitability criterion is applied to each of the measurements of an item and all said measurements are prevented from being used to update the acceptability data if any one of them fails to meet the suitability criterion.

8. A method as claimed in claim 1, including the step of preventing the acceptability data from being usable by the apparatus to define an acceptance criterion if at least a predetermined number of measurements have failed to meet the suitability criteria.

9. A method as claimed in claim 1, including the step of using the acceptability data to define the acceptance criterion even if not all the measurements have met their suitability criteria.

10. A method as claimed in claim 1, wherein the items are coins.

11. A method as claimed in claim 1, wherein the items are banknotes.

12. Apparatus for validating items of value, the apparatus having a first mode in which at least one acceptance criterion is used for testing items, a second mode for calibrating the apparatus by deriving the acceptability criterion, and means for switching the apparatus between the first and second modes, the apparatus being operable in the second mode to take a plurality of genuine item measurements, to apply suitability criteria to the measurements and, if the suitability criteria are met, to use the measurements to define the acceptance criterion, wherein acceptability data, which is used to define the acceptance criterion, is successively updated in accordance with successive measurements deemed to be suitable.

* * * * *